US011608712B2

(12) United States Patent
Werkheiser et al.

(10) Patent No.: US 11,608,712 B2
(45) Date of Patent: Mar. 21, 2023

(54) ACTUATOR APPARATUS USING A PIN-PULLER

(71) Applicant: Halliburton Energy Services, Inc., Houston, TX (US)

(72) Inventors: Gregory Thomas Werkheiser, Denton, TX (US); Michael Linley Fripp, Carrollton, TX (US); Zachary William Walton, Edmond, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 110 days.

(21) Appl. No.: 17/132,124

(22) Filed: Dec. 23, 2020

(65) Prior Publication Data

US 2022/0195842 A1 Jun. 23, 2022

(51) Int. Cl.
*E21B 34/14* (2006.01)

(52) U.S. Cl.
CPC ..... *E21B 34/14* (2013.01)

(58) Field of Classification Search
CPC ..... E21B 34/14
USPC ..... 166/316
See application file for complete search history.

(56) References Cited

U.S. PATENT DOCUMENTS 4,231,283 A 11/1980 Malburg
5,558,153 A 9/1996 Holcombe et al.
6,382,234 B1 * 5/2002 Birckhead ..... E21B 34/066 137/72
8,322,426 B2 * 12/2012 Wright ..... E21B 23/06 166/376
8,429,961 B2 * 4/2013 Irani ..... E21B 49/081 73/152.23
10,101,715 B2 * 10/2018 Lopez ..... E21B 34/066
10,781,677 B2 * 9/2020 Mlcak ..... E21B 43/11852
2010/0175867 A1 7/2010 Wright et al.
(Continued)

FOREIGN PATENT DOCUMENTS

WO WO 2010/096360 A2 8/2010
WO WO 2016/060659 A1 4/2016

OTHER PUBLICATIONS

Search Report and Written Opinion issued for International Patent Application No. PCT/US2021/058160, dated Feb. 23, 2022, 10 pages, ISA/KR.

*Primary Examiner* — Matthew R Buck
*Assistant Examiner* — Patrick F Lambe
(74) *Attorney, Agent, or Firm* — Scott Richardson; C. Tumey Law Group PLLC

(57) ABSTRACT

An electrically-controlled, pin-pulling valve includes a pull pin (e.g., a pull piston) and a chemical propellant. The valve is configured to, using the pull pin and the chemical propellant, actuate from a closed position to an open position to activate a downhole tool. For instance, the pin-pulling valve may, based on an activation signal, activate the chemical propellant, which may cause the chemical propellant to react. The activation of the chemical propellant may cause the pull pin to withdraw from an extended position to a withdrawn position. The withdrawal of the pull pin may cause the pin-pulling valve to open, allowing hydraulic fluids to flow through a port associated with the downhole tool previously sealed by the pin-pulling valve. The flow of the hydraulic fluids may activate the downhole tool by exerting hydraulic pressure on the downhole tool.

20 Claims, 8 Drawing Sheets

(56) References Cited

U.S. PATENT DOCUMENTS

| | | | | |
|---|---|---|---|---|
| 2011/0174068 | A1 | 7/2011 | Irani et al. | |
| 2012/0043092 | A1* | 2/2012 | Arizmendi, Jr. | E21B 41/00 166/330 |

* cited by examiner

ACTUATOR APPARATUS USING A PIN-PULLER

BACKGROUND

1. Field of the Invention

The present disclosure relates generally to systems, tools and associated methods utilized in conjunction with subterranean wellbores, for example, hydrocarbon recovery wellbores. More particularly, embodiments of the disclosure relate to apparatuses and methods for activating a downhole tool using a pin-pulling valve.

2. Background Art

In the hydrocarbon production industry, downhole tools, such as packers, may be introduced in a wellbore and may subsequently require activation or setting. For example, a packer run into the wellbore in a radially contracted configuration may require setting so that a sealing element of the packer radially expands and establishes a seal with a surrounding surface (e.g., a casing pipe or a geologic formation). Activating a downhole tool may involve exerting a mechanical force (a setting force) on the downhole tool. In some cases, this setting force may be applied by hydraulic energy transferred from fluids present in the wellbore to the downhole tool. The transfer of the hydraulic energy in the wellbore may be initiated, for example by puncturing, melting or otherwise causing failure of a rupture disk. The rupture disk may form a hydraulic lock that maintains a piston or valve in a closed position, thereby sealing the hydraulic energy off from the downhole tool. By causing a failure of a rupture disk, the hydraulic lock may release, moving the piston or valve to an open position and activating the downhole tool.

A rupture disk with mechanical properties suitable to withstand a certain range of pressure (e.g., an operational range of pressure) may be selected to maintain the hydraulic lock. However, if the pressure exerted on the rupture disk by the fluids in the wellbore cause the rupture disk to bulge into the pin, the rupture disk may fail prematurely. In this way, the efficiency and robustness of downhole activation apparatuses may be limited by the mechanical properties of the rupture disk.

BRIEF DESCRIPTION OF THE DRAWINGS

The disclosure is described in detail hereinafter on the basis of embodiments represented in the accompanying figures, in which.

DETAILED DESCRIPTION

Figure 1:
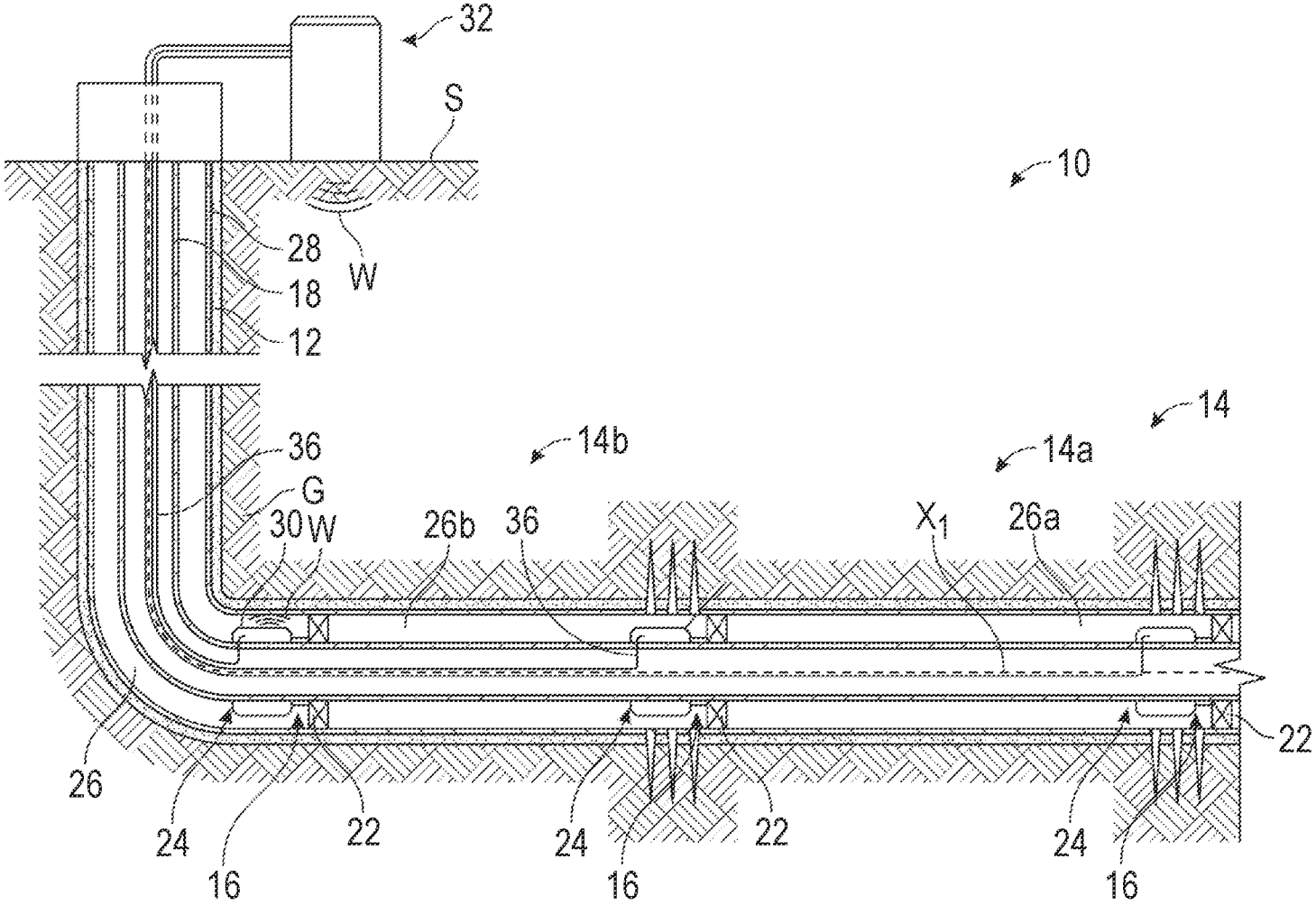
FIG. 1 is a partially cross-sectional schematic view of a well system including a plurality of telemetrically operable packers, each having a hydraulic setting mechanism that includes an electrically-controlled pin-pulling valve in accordance with example embodiments of the present disclosure.

Embodiments of the present disclosure relate to activation of a downhole tool using a pull pin. More specifically, embodiments of the present disclosure relate to an electrically-controlled, pin-pulling valve that includes the pull pin and a chemical propellant (e.g., a chemical energetics material) and is configured to, using the pull pin and the chemical propellant, actuate from a closed position to an open position to activate the downhole tool. For example, the pin-pulling valve may, based on an activation signal, ignite or otherwise activate the chemical propellant, which may cause the chemical propellant to react, producing energy as a combination of heat and/or pressure (e.g., gas). As a result, the activation of the chemical propellant may cause the pull pin (e.g., a pull piston) to withdraw, or shift, from an extended position to a withdrawn position. The withdrawal of the pull pin may cause the pin-pulling valve to open, allowing hydraulic fluids to flow through a port associated with the downhole tool previously sealed by the pin-pulling valve. In some instances, the flow of the hydraulic fluids may activate and/or set the downhole tool by exerting hydraulic pressure on the downhole tool or a portion of the downhole tool (e.g., a setting element, a sealing element, an activation element, and/or the like), for example.

In some embodiments, the pin-pulling valve may operate based on a timer and/or may be in communication (e.g., wired and/or wireless communication) with a control system at the surface. Accordingly, the pin-pulling valve may detect or identify the activation signal to ignite the chemical propellant automatically based on a timer and/or configuration setting or may receive the activation signal from a control system at the surface, as described in greater detail below. Further, a chemical propellant with a high energy density that may be released with a low amount of power may be selected for use in the pin-pulling valve. As such, the pin-pulling valve may more readily be used in complex drilling scenarios, as the power supply and size of the valve may facilitate a compact design of the pin-pulling valve. Further, the application of setting and/or activation pressure for a downhole tool may be simplified by reducing reliance on surface tools. To that end, because a chemical propellant with sufficient power to activate the downhole tool may be selected for use in the pin-pulling valve, the pin-pulling valve may activate the downhole tool without additional pressure applied from the surface. Moreover, the pin-pulling valve may be designed to operate over a wide range of pressures (e.g., hydraulic pressures), as the chemical propellant may be selected to overcome a wide range of pressures to affect the withdrawal of the pull pin and the sealing affected by the pin-pulling valve in the closed position may reduce the risk of premature or unintentional tool activation, as described in greater detail below.

For the purposes of example, embodiments described herein relate to the setting and/or activation of a packer (e.g., an annular packer). However, it may be appreciated that the embodiments of the disclosure are not intended to be limited thereto and that the disclosed apparatus and methods may be applied to any suitable surface or downhole tool. For instance, the pin-pulling valve may be used to deploy a baffle, shift a sleeve to an open or closed position, adjust a flow control, initiate fluid sampling at a fluid-sampling tool, and/or the like.

In the interest of clarity, not all features of an actual implementation or method are described in this specification. Also, the "exemplary" embodiments described herein refer to examples of the present invention. In the development of any such actual embodiment, numerous implementation-specific decisions may be made to achieve specific goals, which may vary from one implementation to another. Such would nevertheless be a routine undertaking for those of ordinary skill in the art having the benefit of this disclosure. Further aspects and advantages of the various embodiments and related methods of the invention will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "below," "lower," "above," "upper," "uphole," "down-hole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

FIG. 1 illustrates a well system 10 in accordance with example embodiments of the present disclosure. In well system 10, a wellbore 12 extends through a geologic formation "G" along a longitudinal axis "$X_1$." A plurality of zones 14 (designated as zones 14*a* and 14*b*) are defined in the wellbore 12 by a plurality of packers 16 longitudinally spaced along a work string 18. In some example embodiments, the work string 18 can comprise a string of tubular members interconnected with one another (e.g., a production or injection tubing string). Although the portion of the wellbore 12 that intersects the zones 14 is depicted as being substantially horizontal, it should be understood that this orientation of the wellbore 12 is not essential to the principles of this disclosure. The portion of the wellbore 12 which intersects the zones 14 could be otherwise oriented (e.g., vertical, inclined, etc.).

The packers 16 each include a sealing element 22 and a setting mechanism 24. The sealing elements 22 fluidly isolate the zones 14*a* and 14*b* from one another in the wellbore 12 and seal off an annulus 26 formed between the work string 18 and a casing 28, which lines the wellbore 12. However, if the portion of the wellbore 12 which intersects the zones 14 were encased or open hole, then the packers 16 could seal between the work string 18 and the geologic formation "G." An annular space 26*a*, 26*b* is defined radially around the work string 18 and longitudinally between the sealing elements 22 for each respective zone 14*a*, 14*b*. With the packers 16 properly set in the annulus 26, various tests or treatments can be performed in one of the annular spaces 26*a* without contaminating or affecting the other annular space 26*b*.

The setting mechanism 24 of each packer 16 can operate to radially expand the respective sealing element 22 to set the packer 16 in the annulus 26. In some embodiments, the setting mechanism 24 of each packer 16 may include an electrically-controlled, pin-pulling valve, as described in greater detail below. In the illustrated embodiment, the setting mechanisms 24 are provided at an up-hole location with respect to each respective sealing element 22. Other relative positions for the setting mechanism 24 are also contemplated such as down-hole of the respective sealing element, radially adjacent the respective sealing element and/or combinations thereof.

The setting mechanisms 24 can each be telemetrically coupled to a surface location "S" by a communication unit 30. The communication units 30 can be communicatively coupled to a surface unit 32 (e.g., a control system) by wireless systems such as acoustic and electromagnetic telemetry systems. Such systems generally include hydrophones or other types of transducers to selectively generate and receive waves "W," which are transmissible through the geologic formation "G" and/or a column of fluid in the wellbore 12. Both the communication unit 30 and the surface unit 32 can send and receive instructions, data and other information via the waves "W." In some embodiments, the communication units 30 can additionally or alternatively be communicatively coupled to the surface unit 32 by control lines 36, which extend through the wellbore 12 to the surface location "S." The control lines 36 can include hydraulic conduits, electrical wires, fiber optic waveguides or other signal transmission media as appreciated by those skilled in the art. In some embodiments, for example, fluidic pressure changes within the hydraulic conduits may encode instructions, data, and other information from and/or to the surface unit 32.

Figure 2:
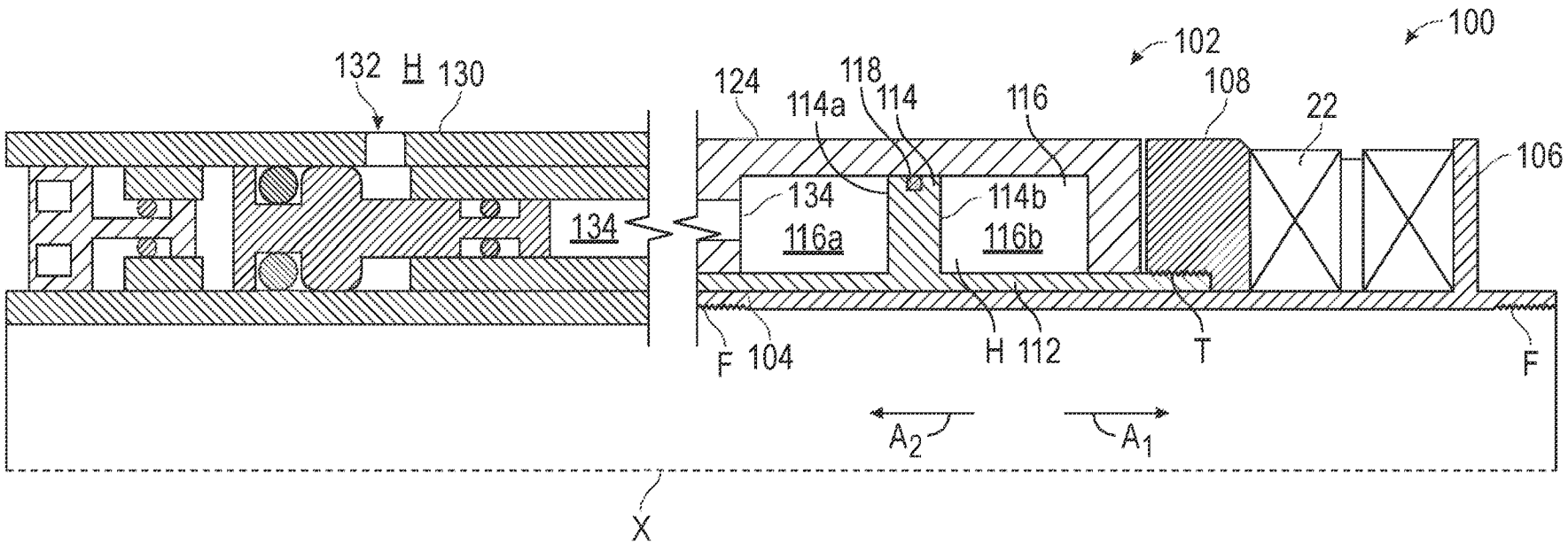
FIG. 2 is a partial, cross-sectional schematic view of one of the packers of FIG. 1 illustrating setting piston of the hydraulic setting mechanism that is operably coupled between the pin-pulling valve and a sealing element of the packer.

Referring to FIG. 2, example embodiments of a telemetrically operable packer 100 are illustrated, which may be employed as any of the packers 16 in well system 10 (FIG. 1). The packer 100 includes a hydraulic setting mechanism 102 for radially expanding a sealing element 22 (e.g., within the well system 10 of FIG. 1). Setting mechanism 102 may be employed as any of the setting mechanisms 24 in well system 10 (FIG. 1) and includes a generally cylindrical mandrel 104 that defines a longitudinal axis "$X_2$." The mandrel 104 can be constructed of a generally rigid material such as steel and can include fasteners "F" such as threads or other fasteners (not shown) disposed at longitudinal ends thereof to enable the mandrel 104 to be interconnected into a work string 18 (FIG. 1). The sealing element 22 is disposed radially about the mandrel 104, and can be constructed of rubber, a synthetic rubber, or another suitable deformable material. The sealing element 22 is disposed axially between an anchor 106 and a setting shoe 108. In some embodiments, the anchor 106 is formed integrally with the mandrel 104 or is otherwise axially fixed with respect to the mandrel 104. The setting shoe 108 is axially movable along the mandrel 104 in the directions of arrows $A_1$ and $A_2$ (toward and away from the anchor 106) to set and unset the sealing element 22. In some embodiments, both the anchor 106 and the setting shoe 108 are axially movable with respect to the sealing element 22 for setting and unsetting the sealing element 22.

A setting piston 112 is coupled to the setting shoe 108 by threads "T" or another mechanism such that axial motion is transferrable between the setting shoe 108 and the setting piston 112. The setting piston 112 includes a flange 114 extending into a fluid chamber 116. The flange 114 defines setting and unsetting faces 114*a* and 114*b* thereon. The setting piston 112 is responsive to operating pressures applied to the setting and unsetting faces 114*a* and 114*b* for reciprocal longitudinal movement with respect to the mandrel 104. For example, hydraulic pressure can be applied to the setting face 114*a* to move the setting piston 112 and the setting shoe 108 in a down-hole direction (arrow $A_1$), and hydraulic pressure can be applied to the unsetting face 114*b* to move the setting piston 112 and the setting shoe 108 in an up-hole direction (arrow $A_2$). The fluid chamber 116 is axially divided into two sub-chambers 116*a*, 116*b* by the flange 114, and the two sub-chambers 116*a*, 116*b* are fluidly isolated from one another by a seal 118 carried by the flange 114.

By providing hydraulic fluid "H" to either sub-chamber 116*a* or 116*b*, and/or simultaneously withdrawing hydraulic fluid from the other sub-chamber 116*a* or 116*b*, the setting piston 112 can be induced to move longitudinally. The hydraulic fluid "H" may include a wellbore fluid surrounding the packer 100, and may be selectively directed to sub-chambers 116*a*, 116*b* to impart a force to the setting and unsetting faces 114*a*, 114*b* of the flange 114. The setting piston 112 is thereby movable in both down-hole (arrow $A_1$) and up-hole (arrow $A_2$) longitudinal directions. Since the flange 114 can drive the setting piston 112 in two longitudinal directions, the setting piston 112 can be described as a "dual-action" piston. In some embodiments, a single-action piston may be provided without departing from the scope of the disclosure. In the illustrated embodiment, the sub-chamber 116*a* is operably coupled to an electrically-controlled, pin-pulling valve 130 that controls setting of the sealing element 22. In the closed position illustrated, the pin-pulling valve 130 may block (e.g., seal off) hydraulic fluid "H" at a port 132 (e.g., a fluid passage) from a fluid passage 134 to the sub-chamber 116*a*. As described in greater detail below, the pin pulling valve 130 is selectively movable to an open position to permit fluid communication between the port 132 and the fluid passage 134 to the sub-channel 116*a*. The hydraulic fluid "H" at the port 132 may have a greater hydrostatic pressure than the pressure of the sub-chamber 116*a*. Accordingly, opening the pin-pulling valve 130 may enable hydraulic fluid "H" to flow through the port 132 into the sub-chamber 116*a*, which may increase the pressure within the sub-chamber 116*a* and the pressure exerted on the setting face 114*a*. In this way, opening the pin-pulling valve 130 may move the setting piston 112 and the setting shoe 108 in the down-hole direction (arrow $A_1$), which may set the sealing element 22 (e.g., set the packer 100). While general operation of the pin-pulling valve 130 is described herein, operation of other similar valves is described in greater detail below with reference to FIGS. 3A-B, 4A-B, 5A-B, 6A-B, 7A-B, and 8.

In some embodiments, the pin-pulling valve 130 may be a single-shot valve. Thus, after the pin-pulling valve 130 is actuated from the closed to open position, the sealing element 22 may not be unset (e.g., the sealing element 22 may be fixedly set). Alternatively, while not illustrated, a second pin-pulling valve 130 may be fluidly coupled to the sub-chamber 116*b* and control unsetting of the sealing element 22. For instance, the second pin-pulling valve 130 may be positioned within a fluid passage between the sub-chamber 116*b* and a chamber or area having a higher hydrostatic pressure than the sub-chamber 116*b*, such as the wellbore 12 and/or the sub-chamber 116*a* (e.g., the sub-chamber 116*a* while the sealing element 22 is set). To that end, by opening the second pin-pulling valve 130, hydraulic fluid "H" may flow into the sub-chamber 116*b*, which may increase the pressure within the sub-chamber 116*b* and the pressure exerted on the setting face 114*b*. In this way, opening the pin-pulling valve 130 may move the setting piston 112 and the setting shoe 108 in the up-hole direction (arrow $A_2$), radially contracting the sealing element 22 (e.g., unsetting the packer 100). Thus, a second pin-pulling valve 130 may be positioned to offset the actuation affected by the illustrated pin-pulling valve 130.

Figure 3A:
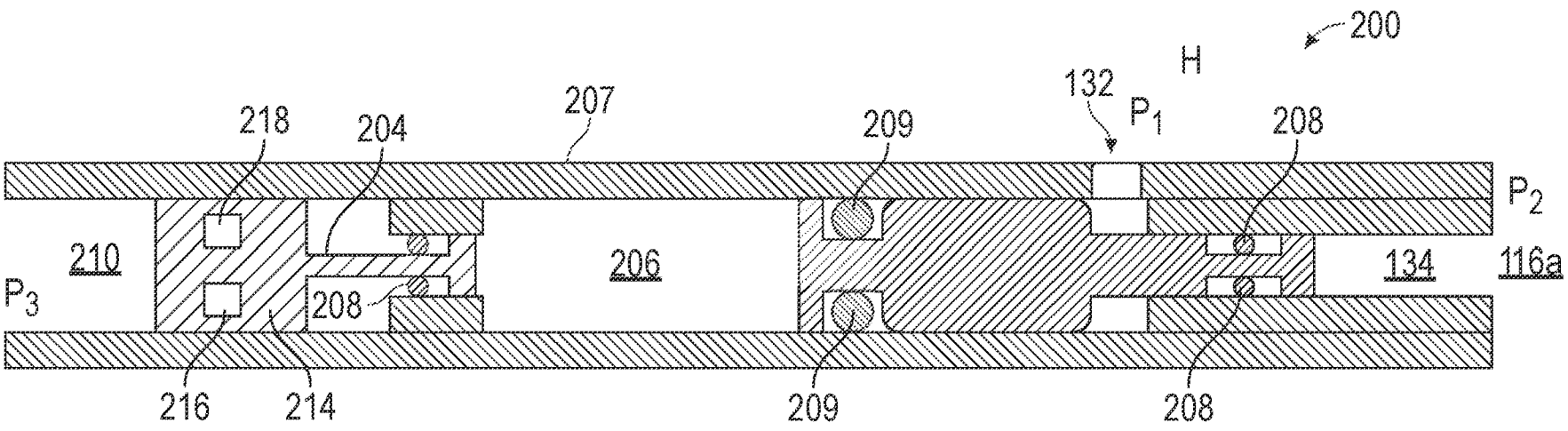
FIGS. 3A and 3B are cross-sectional schematic views of the pin-pulling valve of FIG. 2 in a closed configuration (FIG. 3A) and in an open configuration (FIG. 3B)
Figure 3B:
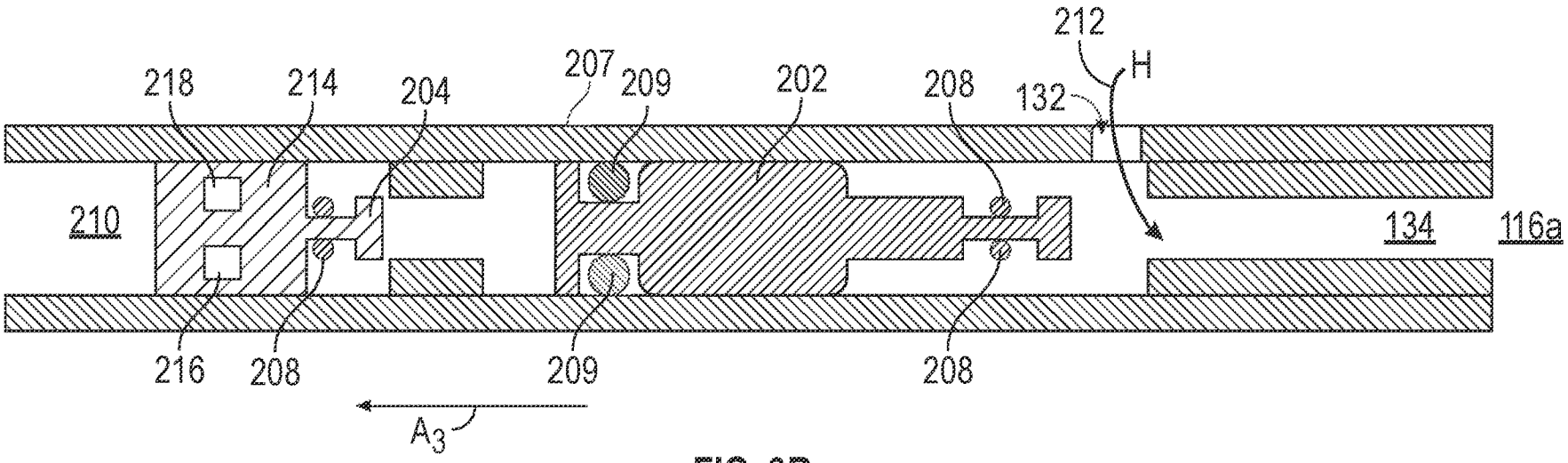

FIGS. 3A and 3B illustrate an electrically-controlled, pin-pulling valve 200 in a closed and open configuration, respectively. The pin-pulling valve 200 may be used to activate or set a downhole tool, such as a packer, as described above with reference to the pin-pulling valve 130 of FIG. 2. As illustrated, the pin-pulling valve 200 may include a sealing piston 202 spaced from a pull pin 204 by a hydraulic lock 206. The hydraulic lock 206 may include a volume of non-compressible fluid captured between the sealing piston 202 and the pull pin 204. The sealing piston 202 and the pull pin 204 may be physically uncoupled from one another, but may be induced to move together as described below. The pin-pulling valve 200 additionally includes a valve housing 207 engaged by the sealing piston 202 and the pull pin 204 at seals 208, 209 carried by the sealing piston 202 and the pull pin 204.

In the closed configuration shown in FIG. 3A, the sealing piston 202 extends across the port 132 such that seals 208, 209 engage the valve housing 207 on opposite sides of the port 132. The seal 208 may block (e.g., seal off) fluid communication between the port 132 and the fluid passage 134, which may open to the sub-chamber 116*a* or another downhole tool. Accordingly, the sealing piston 202 may include or couple to one or more seals 208, such as an O-ring. In some instances, the pressure "P1" (e.g., the hydrostatic pressure) at the port 132 may be greater than the pressure "P2" at the fluid passage 134 and/or the sub-chamber 116*a*. Thus, the hydraulic lock 206 may prevent the pressure "P1" from displacing the sealing piston 202. In some embodiments, the hydraulic lock 206 may include a non-compressible fluid and/or a fluid that may not compress significantly under the application of hydrostatic pressure on the order of 10,000 pounds per square inch (psi). In particular, the non-compressible fluid may exhibit a density that does not change substantially (e.g., by less than 1%) when acted upon by the sealing piston 202. To that end, the hydraulic lock 206 may include a fluid or a mixture of fluids suitable to maintain the hydraulic lock 206 (e.g., maintain the seal between the port 132 and the passage 134) under the pressure differential between pressure "P1" and pressure "P2". For instance, the hydraulic lock 206 may include water, drilling mud, and/or the like. The hydraulic lock 206 may further be maintained by the pull pin 204 in an extended position illustrated in FIG. 3A and a pressure "P3" within a fluid passage 210. The fluid passage 210 may be in fluid communication with or may be separated from the port 132. Thus, the pressure "P3" may be the same as or different from the pressure "P1," respectively.

When the pull pin 204 is withdrawn to the second position illustrated in FIG. 3B, the hydraulic lock 206 may release, example, the non-compressible fluid captured between the sealing piston 202 and the pull pin 204 may flow into fluid passage 210. As a result, the pressure differential between the pressure "P1" and the pressure "P2" may cause the sealing piston 202 to move in a longitudinal direction (arrow $A_3$) towards the pull pin 204, breaking the seal between the port 132 and the passage 134. In particular, the non-compressible fluid may be selected such that the withdrawal of the pull pin 204 to the second position may cause the sealing piston 202 to withdraw a substantially equal distance. Thus, hydraulic fluid "H" may flow from the port 132 to the fluid passage 134 and the sub-chamber 116*a*, as illustrated by arrow 212. In this way, the pin-pulling valve 200 may activate a downhole tool, set the downhole tool, and/or control fluid flow into a chamber, such as sub-chamber 116*a*.

In some embodiments, the pull pin 204 may be integrated in and controlled by a pin actuator 214. More specifically, the pin actuator 214 may control movement of the pull pin 204 from the extended position illustrated in FIG. 3A to the withdrawn position illustrated in FIG. 3B. As described in greater detail below, the pin actuator 214 may include a controller 216, an electrically-controlled ignition 218 (e.g., an ignition switch), and a chemical propellant 252 (FIG. 4A), such as a chemical energetics material. For instance, the controller 216 may activate the electrically-controlled ignition 218, which may ignite the chemical propellant and thereby propel the pull pin 204 to the second position, as described in greater detail below.

Figure 4A:
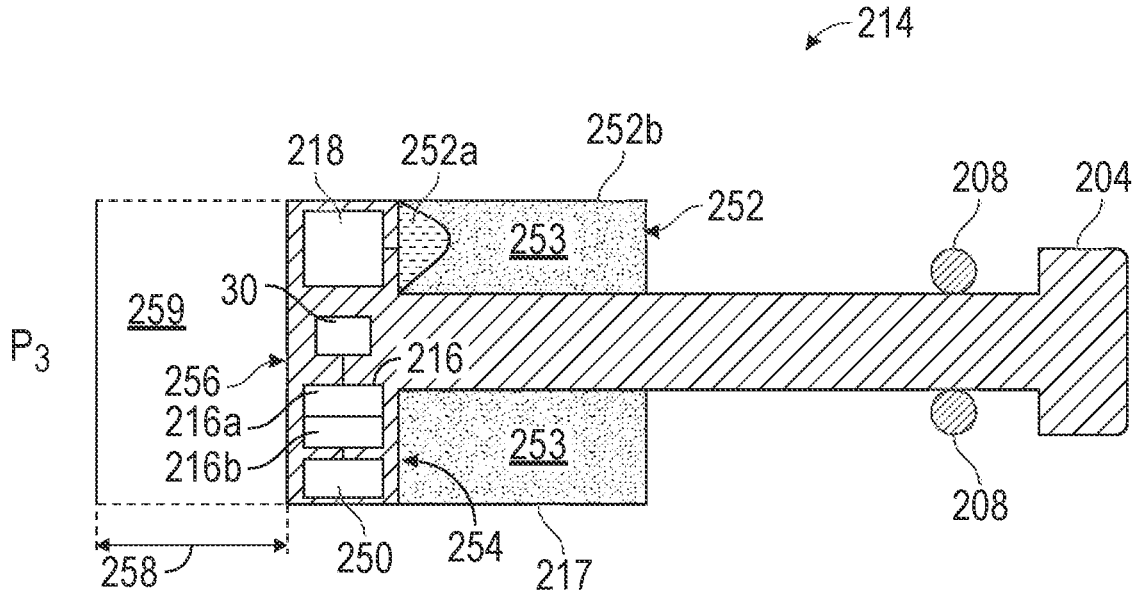
FIGS. 4A and 4B are cross-sectional schematic views of a pin actuator of FIGS. 3A and 3B in a state prior to activation (FIG. 4A) state following activation (FIG. 4B)
Figure 4B:
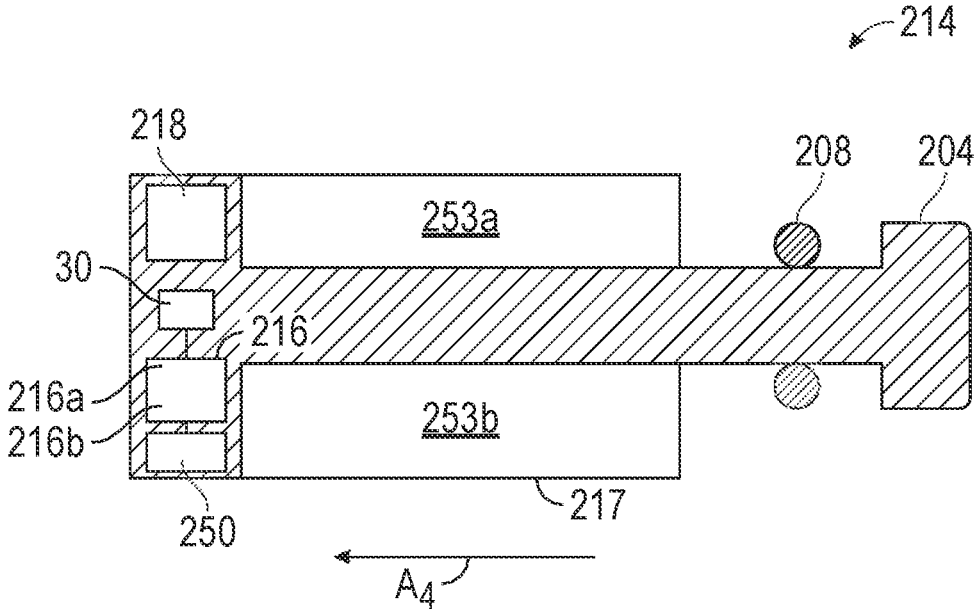

Turning now to FIGS. 4A-4B, an embodiment of the pin actuator 214, which acts as a mechanism to withdraw the pull pin 204 with respect to a pull pin housing 217, is shown in a state before and after activation, respectively. The pull pin housing 217 may be secured in a fixed position within the housing valve 207 of pin pulling valve 200 (FIG. 3A) such that withdrawal of the pull pin 204 releases the hydraulic lock 206.

The pin actuator 214 includes the controller 216, which may be communicatively coupled to a power source 250 and the electrically-controlled ignition 218, positioned within a pull pin housing 217. The controller 216 may control activation of the electrically-controlled ignition 218, e.g., in response to receiving an activation signal from an operator at a control unit (e.g., the surface unit 32 (FIG. 1)) or in response to a timer pre-programmed into the controller 216. The controller 216 may control current (e.g., power) directed to the electrically-controlled ignition 218, which may be implemented as a capacitive discharge ignition, an inductive discharge ignition, and/or the like. For example, the electrically-controlled ignition 218 may be off (e.g., unignited) when no current or current at or below a threshold is directed to the electrically-controlled ignition 218. On the other hand, current exceeding the threshold may activate and effectively ignite (e.g., result in a spark at) the electrically-controlled ignition 218.

As further illustrated in FIG. 4A, the pin actuator 214 may include a chemical propellant 252, such as a chemical energetics material, positioned within the pull pin housing 217 and in operable communication with the electrically-controlled ignition 218. By igniting the electrically-controlled ignition 218 (via the controller 216), the chemical propellant 252 may chemically react, releasing a large amount of energy in a relatively short amount of time (e.g., on the order of 30 milliseconds). The chemical propellant 252 may be formed from a reactive material such as a pyrophoric materials, a combustible material, a Mixed Rare Earth (MRE) alloy or the like including, but not limited to, zinc, aluminum, bismuth, tin, calcium, cerium, cesium, hafnium, iridium, lead, lithium, palladium, potassium, sodium, magnesium, titanium, zirconium, cobalt, chromium, iron, nickel, tantalum, depleted uranium, mischmetal or the like or combination, alloys, carbides or hydrides of these materials. In certain embodiments, the chemical propellant 252 may be formed from the above-mentioned materials in various powdered metal blends and held together with binder material as recognized in the art. These powdered metals may also be mixed with oxidizers to form exothermic pyrotechnic compositions, such as thermites. The oxidizers may include, but are not limited to, boron(III) oxide, silicon (IV) oxide, chromium(III) oxide, manganese(IV) oxide, iron(III) oxide, iron(II, III) oxide, copper(II) oxide, lead(II, III, IV) oxide and the like. The thermites may also contain fluorine compounds as additives, such as Teflon. The thermites may include nanothermites in which the reacting constituents are nanoparticles.

Moreover, in some embodiments, the chemical propellant 252 may be a multi-stage propellant, such as a two-stage propellant. As such, the chemical propellant 252 may include a first stage (e.g., a squib), which may be formed from a first material 252*a*, as well as a second stage, which may be formed from a second material 252*b* that is the same as or different from the first material 252*a*. The first and second material 252*a*, 252*b* may be selected from the above-mentioned materials. Further, the reaction generated by the first material 252*a* (e.g., in response to ignition via the electrically-controlled ignition 218) may ignite the second material 252*b*, which may then release a majority of the energy produced by the chemical propellant 252. In some embodiments, for example, the first material 252*a* may be material that ignites at a relatively low electrical power and, upon reaction, provides suitable power to ignite the second material 252*b* forming the second stage. Further, the ignition of the second stage by the first stage may result in a chemical reaction that releases energy, as described below.

The reaction generated by the chemical propellant 252 may manifest itself through a thermal effect, a pressure effect or both. In either case, the reaction causes an increase in the pressure exerted on the face 254 (e.g., an activation face) of the pull pin 204 within the pull pin housing 217. For instance, the reaction may cause chamber 253 to fill with a gas. As a result, a pressure in the chambers 253 will increase and the pull pin 204 may be forced to withdraw from the extended position illustrated in FIG. 4A along the longitudinal direction indicated by the arrow $A_4$ to the withdrawn position illustrated in FIG. 4B. To that end, the chemical propellant 252 may be selected such that the reaction generated by the chemical propellant 252 causes the pull pin 204 withdraw at least a distance 258, which may correspond to a minimum distance sufficient to actuate the pin-pulling valve 200 to the open configuration illustrated in FIG. 3B (e.g., to actuate the sealing piston 202 such that the port 132 is in fluid communication with the passage 134). More specifically, in some embodiments, the chemical propellant 252 may be selected such that the pressure excited on the face 254 by the reaction generated by the chemical propellant 252 exceeds the pressure exerted on the face 256 of the pull pin 204. The pressure exerted on the face 256 may correspond to a pressure external to the pin actuator 214, such as the pressure "P3". Additionally or alternatively, the pin actuator 214 may include a chamber 259 indicated as optional by the dashed lines, which may be filled with a fluid. In such embodiments, the chemical propellant 252 may be selected such that the pressure exerted on the face 254 by the reaction is sufficient to displace or compress the fluid.

In the illustrated embodiment, the pin actuator 214 is configured for a single-shot actuation. Once the propellant 252 is consumed and the pull pin 204 is withdrawn to the withdrawn position illustrated in FIG. 4B, the pin actuator 214 may not readily be reset to the extended position. As such, offsetting the effect of the actuation of the pin actuator 214 (e.g., resetting and/or deactivating a tool) may involve the use of an additional pin actuator 214.

In some embodiments, the controller 216 of the pin actuator 214 can comprise a control unit, such as a computer including a processor 216*a* and a computer readable medium 216*b* operably coupled thereto. The computer readable medium 216*b* can include a nonvolatile or non-transitory memory with data and instructions that are accessible to the processor 216*a* and executable thereby. In some example embodiments, the computer readable medium 216*b* is operable to be pre-programmed with a plurality of predetermined sequences of instructions for operating the pin actuator 214, the electrically-controlled ignition 218, and/or other actuators to achieve various objectives. For example, the sequences of instructions may enable the controller 216 to activate the electrically-controlled ignition 218, as described above. These instructions can also include initiation instructions for each predetermined sequence of instructions. For example, some of the predetermined sequences of instructions can initiated in response to receiving a predetermined activation signal, such as an ignition activation signal, from a control unit (e.g., the surface unit 32 (FIG. 1)). For example, the activation signal may be received or detected at the controller 216 in response to an input (e.g., a user input) received at the surface unit 32. Some of the predetermined sequences of instructions can be initiated in response to the passage of a predetermined amount of time from deployment. For instance, the surface unit 32 and/or the controller 216 may be equipped with a timer, and after a duration measured by the timer exceeds a threshold, the controller 216 may automatically initiate the instructions. Further, some predetermined sequences of instructions can be initiated only if the processor 216*a* determines that a predetermined set of conditions have been met. The set of conditions may include a temperature and/or a hydrostatic pressure satisfying a threshold at the pin actuator 214, the sealing piston 202, and/or the like, for example.

The controller 216 may further include or communicatively couple to a communication unit 30 (e.g., via a wired or wireless connection, including an electric or hydraulic connection), which is communicatively coupled to the surface location "S" (FIG. 1). For instance, the communication unit 30 may be included within the downhole tool (e.g., as illustrated in FIG. 1) and communicatively couple to the controller 216, may be included within the pin actuator 214 or both. The communication unit 30 can receive instructions from the surface location "S" (e.g., via the surface unit 32) and transmit these instructions to the controller 216. For example, the communication unit 30 can receive a unique ignition activation signal from an operator at the surface location and transmit the ignition activation signal to the controller 216. More specifically, the communication unit 30 can receive the ignition activation signal via an electric, hydraulic, and/or optic connection to the surface location (e.g., via control lines 36). For instance, as described above with reference to FIG. 2, the communication unit 30 can receive the ignition activation signal via waves "W," fluidic pressure changes within a hydraulic conduit, signals on electrical wires, signals on fiber optic waveguides, and/or the like. Responsive to receiving the ignition activation signal, the controller 216 can execute one of the predetermined sequences of instructions for controlling the pin actuator 214 stored on the computer readable medium 216*b*. For example, the controller 216 may execute a sequence to activate the electrically-controlled ignition 218. The communication unit 30 can also transmit a confirmation signal (e.g., an acknowledgment signal) to indicate that the controller 216 has received the ignition signal, has determined that the predetermined sequence of instructions has been completed, and/or has identified an error signal in the event the controller 216 determines that the electrically-controlled ignition 218 failed to ignite, the chemical propellant 252 failed to react, the pull pin 204 failed to operate within a set of parameters (e.g., failed to actuate and/or open the pin-pulling valve 200 of FIGS. 3A-B), and/or the like.

A power source 250 is provided to supply energy for the operation of the pin actuator 214, controller 216, electrically-controlled ignition 218, and/or communication unit 30. In some embodiments, power source 250 comprises a local power source such as a battery that is self-contained within the pin actuator 214 or a self-contained turbine operable to generate electricity responsive to the flow of wellbore fluids therethrough. In some embodiments, power source 250 comprises a connection with the surface location "S" illustrated in FIG. 1 (e.g., an electric or hydraulic connection to the surface location through control lines 36).

Figure 5A:
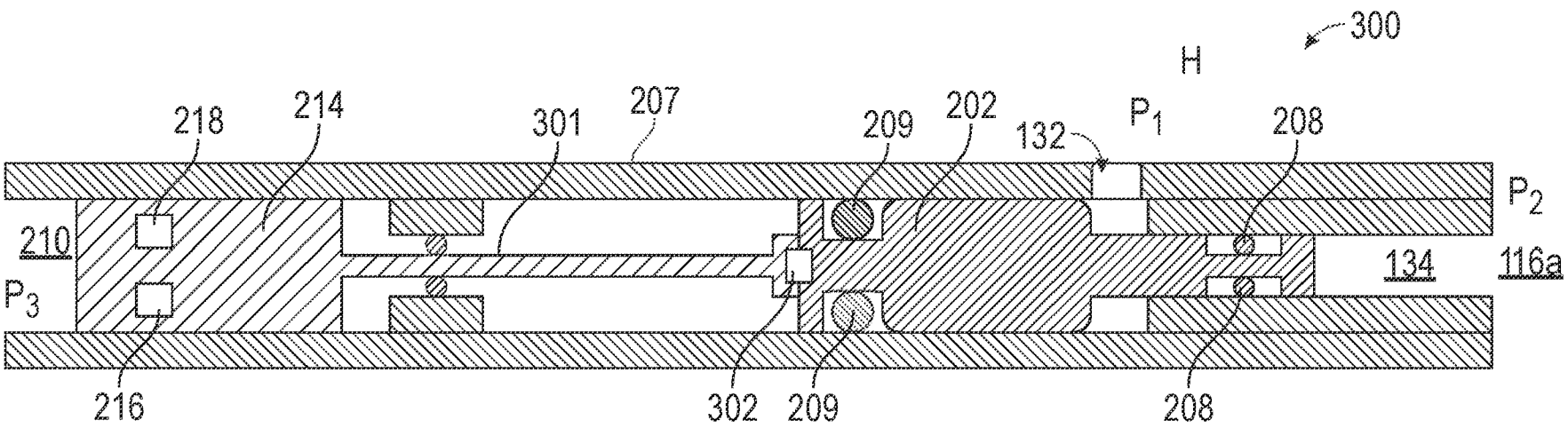
FIGS. 5A and 5B are cross-sectional schematic views of an alternate electrically-controlled, pin-pulling valve having a pull pin coupled to a sealing piston in closed (FIG. 5A) and open (FIG. 5B) configurations in accordance with example embodiments of the present disclosure.
Figure 5B:
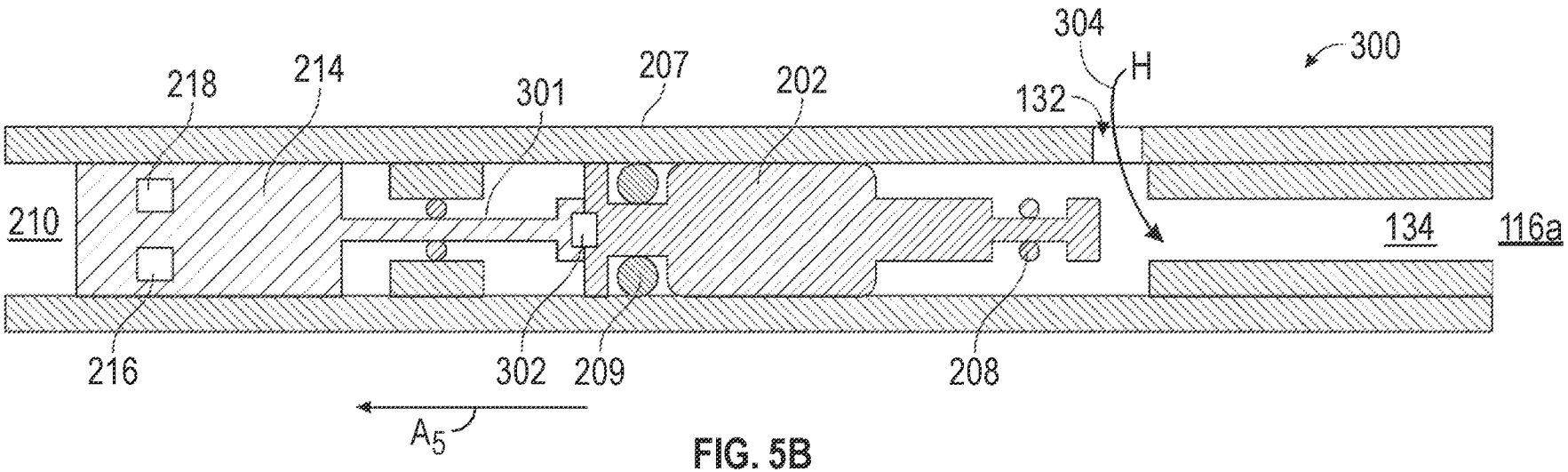

FIGS. 5A-B illustrate an embodiment of an electrically-controlled, pin-pulling valve 300 having a pull pin 301, which may be similar to pull pin 204, of a pin actuator 214 coupled to a sealing piston 202 in a closed and open configuration, respectively. As illustrated, the pull pin 301 may be coupled to the sealing piston 202 via a fastener 302. The fastener 302 may include a weld, a snap-fit fastener, a pressure-fit fastener, threading, and/or the like. Alternatively, the pull pin 301 may be integrally formed with the sealing piston 202. In either case, because the pull pin 301 and the sealing piston 202 are coupled together, the pin-pulling valve 300 may lack a hydraulic lock of fluid (e.g., the hydraulic lock 206 of FIGS. 3A-B). However, the basic actuation mechanism of the pin-pulling valve 300 is generally similar to that of the pin-pulling valve 200 illustrated in FIGS. 3A-B. To that end, by causing the pull pin 301 to withdraw, the sealing piston 202 may also withdraw (e.g., in the direction of arrow $A_5$), opening the pin-pulling valve 300, and facilitating fluid communication between the port 132 and the fluid passage 134, as illustrated in FIG. 5B. Thus, as described above, hydraulic fluid "H" may flow from the port 132 to the fluid passage 134, as indicated by arrow 304, which may activate a tool in communication with the fluid passage 134.

While the pull pin 301 and the sealing piston 202 are illustrated as coupled in both FIGS. 5A and 5B, embodiments are not limited thereto. In some embodiments, for example, withdrawing the pull pin 301 may cause the pull pin 204 to separate from the sealing piston 202. In any case, withdrawal of the pull pin 301 may affect sufficient motion of the sealing piston 202 to open the pin-pulling valve.

Figure 6A:
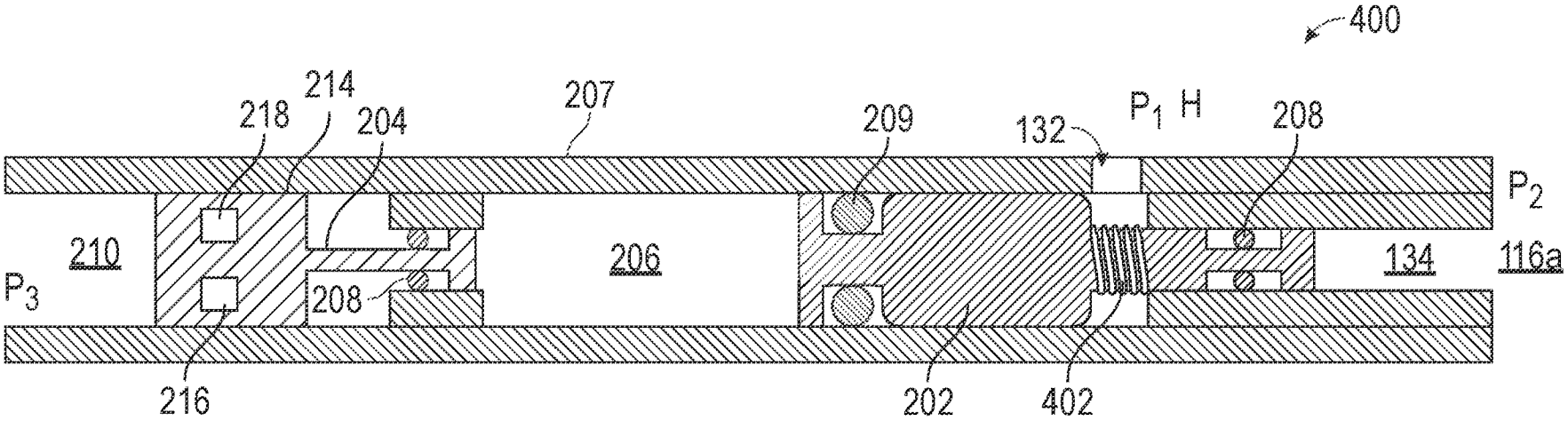
FIGS. 6A and 6B are cross-sectional schematic views of an alternate electrically-controlled, pin-pulling valve having a mechanical spring in closed (FIG. 6A) and open (FIG. 6B) configurations in accordance with example embodiments of the present disclosure.
Figure 6B:
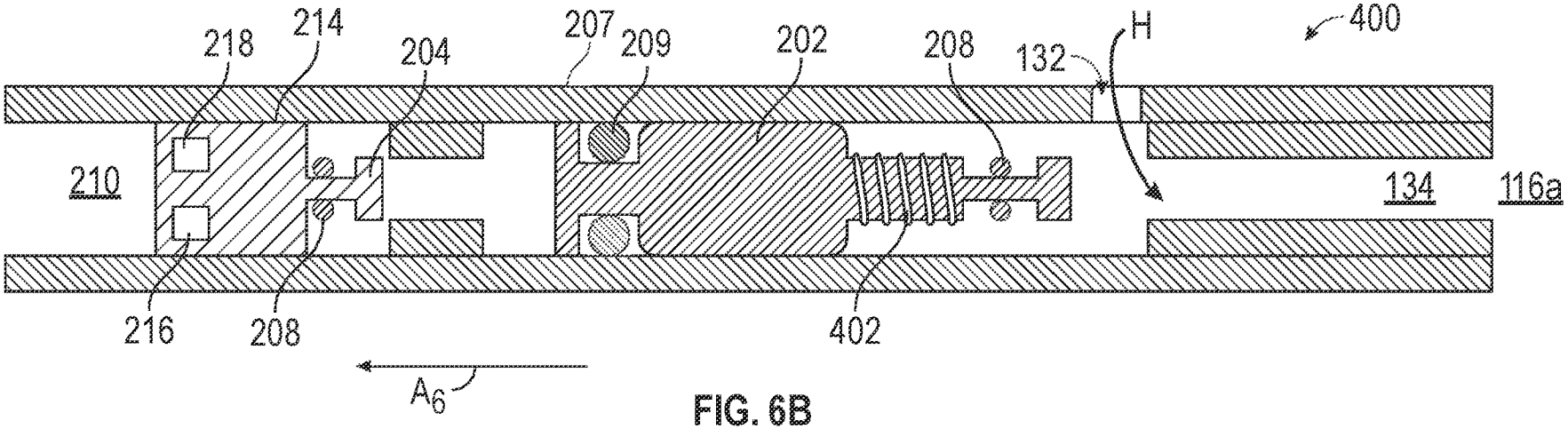

Turning now to FIGS. 6A-B, an embodiment of an electrically-controlled, pin-pulling valve 400 suitable for use in systems having a small pressure and/or a small pressure differential is illustrated in a closed and an open configuration, respectively. More specifically, the pin-pulling valve 400 may open (based on an electrical control) even when the pressure "P1" at the port 132 is the same as or relatively close in magnitude to the pressure "P2" at the fluid passage 134 and/or when both the pressure "P1" and the pressure "P2" are relatively small. For instances, in cases where the pressures "P1" and "P2" are small and/or have a small pressure differential, the force (e.g., hydraulic pressure) exerted on the sealing piston 202 may be insufficient to move the sealing piston 202 along the longitudinal direction indicated by the arrow $A_6$ to a position enabling fluid communication between the port 132 and the fluid passage 134 (e.g., a position corresponding to the open configuration of the pin-pulling valve 400) even after release of the hydraulic lock 206. To that end, withdrawal of the pull pin 204 at the pin actuator 214, alone, may be insufficient to actuate the sealing piston 202 to the position enabling fluid communication between the port 132 and the fluid passage 134.

Accordingly, in some embodiments, the sealing piston 202 may be outfitted with a mechanical spring 402 compressed between the valve housing 207 and the sealing piston 202.

When the pin-pulling valve 400 is in the closed configuration illustrated in FIG. 6A, the mechanical spring 402 may be compressed by the hydraulic lock 206, for example. In this way, when the pull pin 204 is withdrawn (and the hydraulic lock 206 is released), the energy stored by the mechanical spring 402 may be released, helping to propel the sealing piston 202 to the open position illustrated in FIG. 6B. Thus, the mechanical spring 402 may be selected to store and subsequently release a certain amount of energy.

It should be appreciated that the mechanical spring 402 may be included in any pin-pulling valve, including the pin-pulling valve 200 of FIGS. 3A-B. Moreover, by including the mechanical spring 402 on the sealing piston 202, the pressure exerted by the hydraulic fluids (e.g., pressures "P1" and/or "P2"), the energy used to withdraw the pull pin 204 (e.g., via the reaction of the chemical propellant 252), or both may be reduced. For instance, by redistributing a portion of the energy to move the sealing piston 202 to the mechanical spring 402, the energy used elsewhere, such as at the pin actuator 214, may be reduced. To that end, the chemical propellant 252 may be selected to produce a smaller energy upon reaction in embodiments incorporating the mechanical spring 402 than those without the mechanical spring 402. Thus, while the embodiments illustrated in FIGS. 6A-B are described with respect to systems with lower pressure or lower pressure differentials, the pin-pulling valve 400 may be used in any suitable system.

Figure 7A:
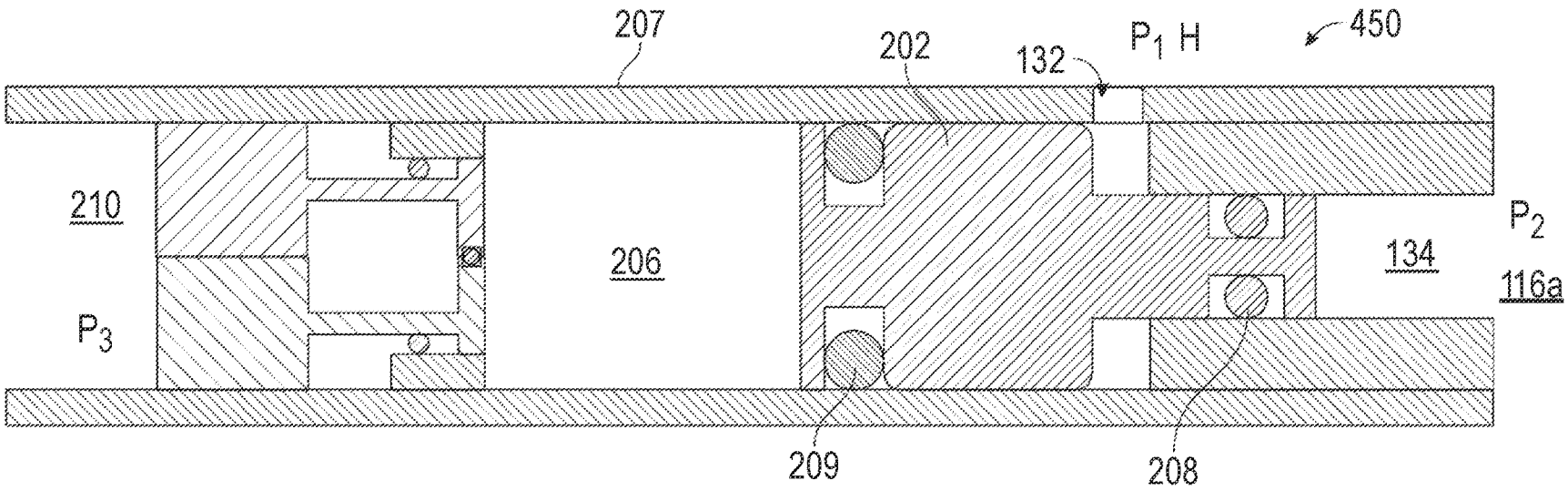
FIGS. 7A and 7B are cross-sectional schematic views of an alternate electrically-controlled, pin-pulling valve having a first pin actuator and a second pin actuator in parallel in a closed (FIG. 7A) and open (FIG. 7B) configurations in accordance with example embodiments of the present disclosure.
Figure 7B:
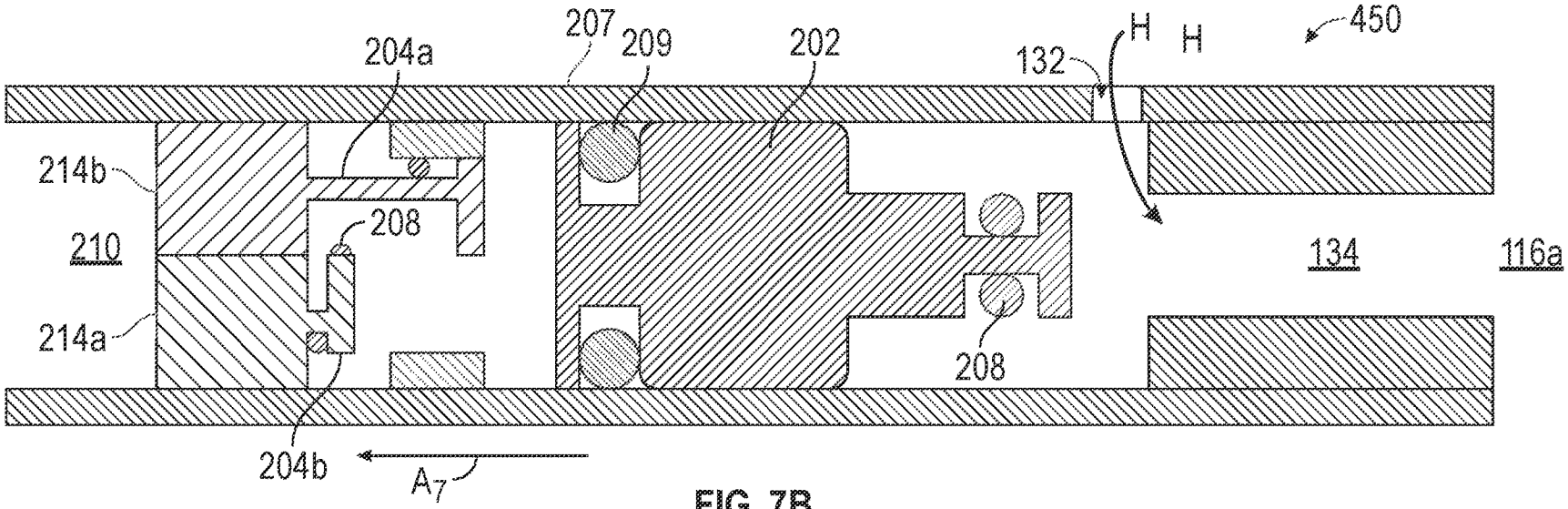

FIGS. 7A-7B illustrate an electrically-controlled, pin-pulling valve 450 implemented with parallel pull pins 204 in a closed configuration and an open configuration, respectively. More specifically, FIG. 7A illustrates a first pull pin 204*a* controlled by a first pin actuator 214*a* positioned in parallel with a second pull pin 204*a* controlled by a second pin actuator 214*b*. In some embodiments, the first pin actuator 214*a* may be separate and distinct from the second pin actuator 214, while, in other embodiments, the first pin actuator 214*a* may communicatively couple to and/or share one or more components with the second pin actuator 214*b*. For instance, the first pin actuator 214*a* and the second pin actuator 214*b* may share a common controller 216, respective controllers that are communicatively coupled, or separate controllers 216. In any case, the first and second pull pins 204*a-b* may, when withdrawn, independently or simultaneously cause the pin-pulling valve 450 to open. In some embodiments, for example, the second pull pin 204*b* may be provided for the purpose of redundancy. That is, for example, the second pull pin 204*b* may actuate the pin-pulling valve 450 even in the case of failure of the first pull pin 204*a* or vice versa. In other words, because the pin actuators 214*a-b* may be implemented for single-shot activation, use of the pin actuators 214*a-b* in parallel may account for instances where one of the pin actuators 214*a* or 214*b* malfunctions and may not be reactivated.

For example, if the chemical propellant 252 of the first pin actuator 214*a* does not react fully or does not react well enough to supply the pressure to withdraw the first pull pin 204*a* a sufficient distance, activation of the second pin actuator 214*b* and the resulting withdrawal of the second pull pin 204*b* may be sufficient to open the pin-pulling valve 450 by actuating the sealing piston in the direction of arrow $A_7$, as illustrated in FIG. 7B. In some embodiments, the first and second pin actuators 214*a-b* may be configured for simultaneous activation (e.g., simultaneous ignition at the respective electrically-controlled ignition 218). In other embodiments, the second pin actuator 214*b* may activate and withdraw the second pull pin 204*b* only after it is determined that activation of the first pin actuator 214*a* malfunctioned. For instance, the controller 216 of the first pin actuator 214*a* may transmit a message indicating the malfunction to the surface unit 32 and/or the controller 216 of the second pin actuator 214*b*, and the second pin actuator 214*b* may activate in response to the message.

Additionally or alternatively, a pin actuator, such as the pin actuators 214*a-b*, may be configured to re-activate, if possible. For instance, if the electrically-controlled ignition 218 of a pin actuator 214 does not ignite in response to activation by the controller 216, an additional attempt at activation may be made by the controller 216. Similarly, if an activation signal from the surface (e.g., from the surface unit 32) is not received at the pin actuator 214, the activation signal may be retransmitted.

It may be appreciated that while two pin pulls 204*a-b* and two pin actuators 214*a-b* are illustrated in FIGS. 7A-7B, any number of pin pulls 204, pin actuators 214, and/or sealing pistons 202 may be used in parallel within a pin-pulling valve. That is, embodiments described herein are not intended to be limiting. Moreover, while components (e.g., pin pulls 204, pin actuators 214) of a single pin-pulling valve are illustrated within a common valve housing 207, any number of separate pin-pulling valves having different housings, for example, may be used in parallel.

Figure 8:
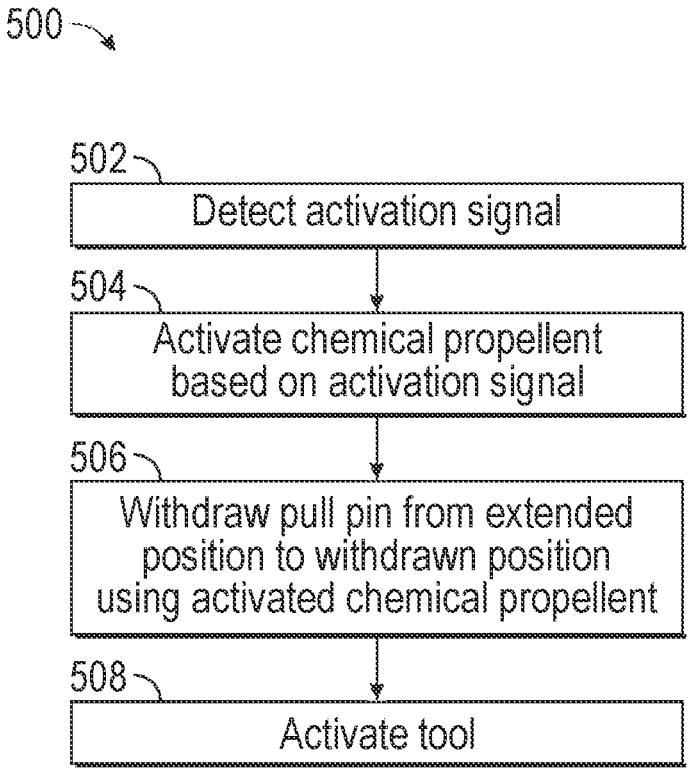
FIG. 8 is a flowchart illustrating a method of operating a pin-pulling valve to activate a tool in accordance with example embodiments of the present disclosure.

Referring now to FIG. 8, and with continued reference to FIGS. 1, 2, 3A-B, 4A-B, 5A-B, 6A-B, and 7A-B an example operational procedure 500 that employs at least one of the electrically-controlled, pin-pulling valves 130, 200, 300, 400, or 450 and may be used to activate and/or set a tool is illustrated. The procedure 500 can be initiated with detection of an activation signal (e.g., an ignition activation signal) at the controller 216 of a pin actuator 214 (step 502). The chemical propellant 252 of the pin actuator 214 may then be activated by the controller based on the activation signal (step 504), and the pull pin 204 may be withdrawn from an extended position to a withdrawn position using the activated chemical propellant 252 (step 506) on the work string 18. In response to the pull pin 204 being withdrawn to the second position, a tool, such as packer 16 and/or 100 may be activated (step 508).

As described herein, the controller 216 of a pin actuator 214 may detect, at step 502, the activation signal based on a signal received from a control unit, such as the surface unit 32 of FIG. 1. As such, the procedure 500 may be initiated in response to a user input, via an input/output (I/O) device, communicatively coupled to the control unit. For instance, the surface unit 32 may be configured to, in response to a user input from a mouse, touchscreen, keyboard, and/or the like communicatively coupled to the surface unit 32, transmit an activation signal to the controller 216. Additionally or alternatively, the control unit may be configured to transmit the activation signal based on a time elapsed at a timer and/or in response to a condition, such as determining the pin actuator 214 is positioned within the wellbore, determining a temperature and/or hydrostatic pressure satisfies a threshold at the pin actuator 214, the sealing piston 202, and/or the like. In any case, the controller 216 may receive and detect the transmitted activation signal.

In other embodiments, the controller 216 (e.g., a control unit) may generate the activation signal itself. For instance, the controller 216 may generate and detect the activation signal based on a timer within the controller 216 and/or based on a condition, such as a temperature and/or a hydrostatic pressure at the pin actuator 214, the sealing piston 202, and/or the like. Moreover, in some embodiments, the controller 216 may detect the activation signal based on a combination of a signal received from the surface (e.g., via the surface unit 32) and a signal generated at the controller 216.

After detecting the activation signal, the controller 216 may activate the chemical propellant 252 at step 504. In some embodiments, for example, the controller 216 may direct power (e.g., a current) from the power source 250 to the electrically-controlled ignition 218, which may be coupled to the chemical propellant 252, as illustrated in FIG. 4A. More specifically, the controller 216 may direct power sufficient to ignite (e.g., spark) the electrically-controlled ignition 218, which may cause the chemical propellant 252 to react.

The reaction of the chemical propellant 252 may cause the pull pin 204 of the pin actuator 214 to withdraw from an extended position (illustrated in FIG. 4A) to a second position (illustrated in FIG. 4B) at step 506. For instance, the reaction caused by activating the chemical propellant 252 may exert sufficient pressure on the face 254 of the pull pin 204 to cause the pull pin 204 to slide in the direction of arrow $A_4$. Moreover, as described herein, movement of the pull pin 204 from the extended position to the withdrawn position may cause the sealing piston 202 to actuate from a first position (e.g., a closed configuration) to a second position (e.g., an open configuration). To that end, the sealing piston 202 may be integrally formed with or coupled to (e.g., via fastener 302) the pull pin 204 and may move together with the pull pin 204. Alternatively, the sealing piston 202 may be spaced form the pull pin 204 by a hydraulic lock 206, and the movement of the sealing piston 202 may be realized by the withdrawal of the pull pin 204 and the resulting release of the hydraulic lock 206. Further, in some embodiments, movement of the sealing piston 202 may be aided by the release of energy from a mechanical spring 402.

By withdrawing the pull pin 204 to the second position and thereby causing the sealing piston 202 to move, the reaction of the chemical propellant 252 may cause an electrically-controlled, pin-pulling valve (e.g., pin-pulling valve 130, 200, 300, 400, 450) to transition from a closed configuration to an open configuration, which may activate a tool (e.g., a downhole tool) at step 508. More specifically, the pin-pulling valve may transition to a state that enables fluid flow between a first fluid passage, such as the port 132, and a second fluid passage, such as the fluid passage 134. For instance, based at least on a pressure "P1" corresponding to a hydrostatic pressure at the first fluid passage and a pressure "P2" corresponding to a hydrostatic pressure at the second fluid passage, opening the pin-pulling valve may enable hydrostatic fluid "H" to fluid from the first fluid passage to the second fluid passage. In this way, the hydrostatic fluid "H" may increase the pressure in a chamber, such as sub-chamber 116*a* (FIG. 2), in fluid communication with the second fluid passage. In some embodiments, the tool may be activated and/or set, at step 508, by this increase in pressure (e.g., hydrostatic pressure) in the chamber.

For instance, in the case of a packer (e.g., packer 16, 100), the increase in pressure within the chamber (e.g., sub-chamber 116*a*) may increase pressure exerted on a setting face 114*a*, as illustrated and discussed above with reference to FIG. 2. In this way, opening the pin-pulling valve may move the setting piston 112 and the setting shoe 108 in the down-hole direction (arrow $A_1$), which may set the sealing element 22 and set the packer 16, 100. Similarly, the increase in pressure within the chamber may be used to activate a sleeve by shifting a sleeve from an open position to a closed position or from a closed position to an open position. Additionally or alternatively, opening the pin-pulling valve may cause a fluid sample to be drawn into the chamber, which may activate a fluid-sampling tool by initiating fluid sampling within the fluid-sampling tool. Moreover, opening the pin-pulling valve may be used to adjust flow control between the first fluid passage and the second fluid passage and/or between additional fluid passages, and/or opening the pin-pulling valve may cause a baffle to be deployed. To that end, any suitable downhole tool or surface tool that may be set or activated using a difference in pressure, such as hydrostatic pressure, between two or more fluid passages may utilize the procedure 500 and the pin-pulling valve for activation. Thus, while embodiments described herein relate to packers and other downhole tools, it may be appreciated that the systems, methods, and/or techniques may be applied for activation or setting of any suitable tool.

Further, in some embodiments, multiple pin-pulling valves may be included in a well system 10, as illustrated in FIG. 1. Thus, the operational procedure 500 may be repeated to independently activate different tools associated with a respective pin-pulling valve or may be performed simultaneously to activate multiple tools relatively concurrently. For instance, the surface unit 32 may be configured to transmit an activation signal to a first controller 216 corresponding to a first pin actuator for a first tool and a second controller 216 corresponding to a second pin actuator for a different, second tool simultaneously. Accordingly, the first controller 216 and the second controller 216 may detect the activation signal at step 502 relatively simultaneously and may then proceed to perform the operational procedure 500 to activate the respective took.

Moreover, any of the methods described herein may be embodied within a system including electronic processing circuitry to implement any of the methods, or a in a computer-program product including instructions which, when executed by at least one processor, causes the processor to perform any of the methods described herein.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

According to a first aspect, the disclosure is directed to a pin-pulling valve apparatus. The apparatus includes a valve housing defining first and second fluid passages. A sealing piston is movable with respect to the valve housing from a closed position in which fluid communication between the first and second fluid passages is blocked by the sealing piston and an open position in which fluid communication between the first and second fluid passages is permitted. A pull pin is movable from an extended position to a withdrawn position with respect to a pull pin housing in response to an increase of pressure applied to an activation face defined on the pull pin and positioned within the pull pin housing. A chemical propellant is positioned within the pull pin housing and is selectively reactive to increase the pressure applied to the activation face of the pull pin. A controller is operable to activate the chemical propellant in response to receiving an activation signal. The sealing piston is movable from the closed position to the open position in response to the movement of the pull pin from the extended position to the withdrawn position.

In one or more embodiments, the apparatus further includes a hydraulic lock positioned between the pull pin and the sealing piston, wherein the hydraulic lock includes a volume of fluid captured in the valve housing that is released in response to the movement of the pull pin from the extended position to the withdrawn position. The pull pin may be uncoupled from the sealing piston and wherein the hydraulic lock comprises a non-compressible fluid.

In some embodiments, the pull pin is coupled to the sealing piston. The pull pin may be coupled to the sealing piston via a fastener. In one or more embodiments, the apparatus further includes an electrically-controlled ignition positioned within the pull pin housing and communicatively coupled to the controller, wherein the electrically-controlled ignition is operable to activate the chemical propellant in response to receiving, via the controller, a current above a threshold.

In some embodiments, the apparatus further includes a power source positioned within the pull pin housing and communicatively coupled to the controller. In some embodiments, the pull pin is one of a pair of pull pins arranged in parallel, wherein the sealing piston is configured to move from the closed position to the open position in response to the movement of at least one of the pull pins from the extended position to the withdrawn position. In some embodiments, the apparatus further includes a mechanical spring operably engaged with the sealing piston such that the sealing piston is moveable from the closed position to the open position at least in part in response to on a release of energy stored in the mechanical spring. In some embodiments, the pull pin housing is coupled to the valve housing in a fixed position with respect to the valve housing.

In another aspect, the disclosure is directed to a downhole tool activation system. The system includes a valve housing defining first and second fluid passages, a downhole tool fluidly coupled to the second fluid passage, and a sealing piston movable with respect to the valve housing from a closed position in which fluid communication between the first and second fluid passages is blocked by the sealing piston and an open position in which in which fluid communication between the first and second fluid passages is permitted. A pull pin is positioned movable from an extended position to a withdrawn position with respect to a pull pin housing in response to an increase of pressure applied to an activation face defined on the pull pin and positioned within the pull pin housing. A chemical propellant is positioned within the pull pin housing and selectively reactive to increase the pressure applied to the activation face of the pull pin, and a controller is operable to activate the chemical propellant in response to receiving an activation signal. The sealing piston is movable from the closed position to the open position in response to the movement of the pull pin from the extended position to the withdrawn position.

In one or more embodiments, the system further includes a control unit operable to transmit the activation signal. The control unit may include a timer, and the control unit may be configured to transmit the activation signal in response to a time elapsed at the timer. The control unit, in some embodiments, is communicatively coupled to an input/output (I/O) device, and the surface unit is configured to transmit the activation signal in response to receiving an input from the I/O device. In some embodiments the downhole tool includes one or more of a packer, a baffle, a fluid-sampling tool, a valve, or a sleeve.

In another aspect, the disclosure is directed to a method of activating a downhole tool in a wellbore via a pin-pulling valve. The method includes detecting, at a controller of the pin-pulling valve, an activation signal, activating, via the controller, a chemical propellant of the pin-pulling valve in response to detecting the activation signal, withdrawing, using the activated chemical propellant, a pull pin of the pin-pulling valve from an extended position to a withdrawn position with respect to a pull pin housing, moving, in response to withdrawing the pull pin, a sealing piston of the pin-pulling valve from a closed position in which fluid communication between first and second fluid passages defined by a valve housing is blocked by the sealing piston to an open position in which fluid communication between the first and second fluid passages is permitted, and responsive to the sealing piston moving to the open position, communicating fluid from the first fluid passage to the downhole tool through the second fluid passage to activate the downhole tool.

In some embodiments, the method further includes increasing a pressure applied to an activation face of the pull pin with the activated chemical propellant to thereby withdraw the pull pin. Activating the chemical propellant may further include igniting, using the controller, an electrically-controlled ignition in communication with the chemical propellant.

In one or more embodiments, withdrawing the pull pin may further include releasing a hydraulic lock between the pull pin and the sealing piston of the pin-pulling valve. Activating the downhole tool may include one or more of setting a packer, deploying a baffle, shifting a sleeve or a valve or initiating fluid sampling at a fluid-sampling tool.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A pin-pulling valve apparatus, comprising:

a valve housing defining first and second fluid passages;

a sealing piston movable with respect to the valve housing from a closed position in which fluid communication between the first and second fluid passages is blocked by the sealing piston and an open position in which fluid communication between the first and second fluid passages is permitted;

a pull pin housing disposed within the valve housing;

a pull pin disposed within the pull pin housing in an extended position wherein the pull pin extends a first distance from the pull pin housing, the pull pin movable from the extended position to a withdrawn position in which the pull pin extends from the pull pin housing a second distance that is less than the first distance in response to an increase of pressure applied to an activation face defined on the pull pin and positioned within the pull pin housing;

a chemical propellant positioned within the pull pin housing and selectively reactive to increase the pressure applied to the activation face of the pull pin; and a controller operable to activate the chemical propellant in response to receiving an activation signal;

wherein the sealing piston is movable from the closed position to the open position in response to the movement of the pull pin from the extended position to the withdrawn position.

2. The apparatus of claim 1, further comprising a hydraulic lock positioned between the pull pin and the sealing piston, wherein the hydraulic lock comprises a volume of fluid captured in the valve housing that is released in response to the movement of the pull pin from the extended position to the withdrawn position.

3. The apparatus of claim 2, wherein the pull pin is uncoupled from the sealing piston and wherein the hydraulic lock comprises a non-compressible fluid.

4. The apparatus of claim 1, wherein the pull pin is coupled to the sealing piston.

5. The apparatus of claim 4, wherein the pull pin is coupled to the sealing piston via a fastener.

6. The apparatus of claim 1, further comprising an electrically-controlled ignition positioned within the pull pin housing and communicatively coupled to the controller, wherein the electrically-controlled ignition is operable to activate the chemical propellant in response to receiving, via the controller, a current above a threshold.

7. The apparatus of claim 1, further comprising a power source positioned within the pull pin housing and communicatively coupled to the controller.

8. The apparatus of claim 1, wherein the pull pin is one of a pair of pull pins arranged in parallel, wherein the sealing piston is configured to move from the closed position to the open position in response to the movement of at least one of the pull pins from the extended position to the withdrawn position.

9. The apparatus of claim 1, further comprising a mechanical spring operably engaged with the sealing piston such that the sealing piston is moveable from the closed position to the open position at least in part in response to on a release of energy stored in the mechanical spring.

10. The apparatus of claim 1, wherein the pull pin housing is coupled to the valve housing in a fixed position with respect to the valve housing.

11. A downhole tool activation system comprising:

a valve housing defining first and second fluid passages;

a downhole tool fluidly coupled to the second fluid passage;

a sealing piston movable with respect to the valve housing from a closed position in which fluid communication between the first and second fluid passages is blocked by the sealing piston and an open position ire which in which fluid communication between the first and second fluid passages is permitted;

a pull pin housing disposed within the valve housing;

a pull pin positioned within the pull pin housing and movable from an extended position to a withdrawn position with respect to the pull pin housing in response to an increase of pressure applied to an activation face defined on the pull pin and positioned within the pull pin housing, wherein the pull pin extends from the pull pin housing a first distance in the extended position and a second distance in the withdrawn position, and wherein the second distance is less than the first distance;

a chemical propellant positioned within the pull pin housing and selectively reactive to increase the pressure applied to the activation face of the pull pin; and a controller operable to activate the chemical propellant in response to receiving an activation signal;

wherein the sealing piston is movable from the closed position to the open position in response to the movement of the pull pin from the extended position to the withdrawn position.

12. The system of claim 11, further comprising a control unit operable to transmit the activation signal.

13. The system of claim 12, wherein the control unit comprises a timer, and wherein the control unit is configured to transmit the activation signal in response to a time elapsed at the timer.

14. The system of claim 12, wherein the control unit is communicatively coupled to an input/output (I/O) device, and wherein the surface unit is configured to transmit the activation signal in response to receiving an input from the I/O device.

15. The system of claim 11, wherein the downhole tool comprises one or more packer, a baffle, a fluid-sampling tool, a valve, or a sleeve.

16. A method of activating a downhole tool in a wellbore via a pin-pulling valve, the method comprising:

detecting, at a controller of the pin-pulling valve, an activation signal;

activating, via the controller, a chemical propellant of the pin-pulling valve in response to detecting the activation signal;

withdrawing, using the activated chemical propellant, a pull pin of the pin-pulling valve from an extended position to a withdrawn position with respect to a pull pin housing, wherein the pull pin extends from the pull pin housing a first distance in the extended position and a second distance in the withdrawn position, and wherein the second distance is less than the first distance;

moving, in response to withdrawing the pull pin, a sealing piston of the pin-pulling valve from a closed position in which fluid communication between first and second fluid passages defined by a valve housing is blocked by the sealing piston to an open position in which fluid communication between the first and second fluid passages is permitted; and responsive to the sealing piston moving to the open position, communicating fluid from the first fluid passage to the downhole tool through the second fluid passage to activate the downhole tool.

17. The method of claim 16, further comprising increasing a pressure applied to an activation face of the pull pin with the activated chemical propellant to thereby withdraw the pull pin.

18. The method of claim 16, wherein activating the chemical propellant further comprises igniting, using the controller, an electrically-controlled ignition in communication with the chemical propellant.

19. The method of claim 16, wherein withdrawing the pull pin further comprises releasing a hydraulic lock between the pull pin and the sealing piston of the pin-pulling valve.

20. The method of claim 16, wherein activating the downhole tool comprises one or more of:

setting a packer;

deploying a baffle;

shifting a sleeve or a valve; or
initiating fluid sampling at a fluid-sampling tool.

* * * * *